US006668728B2

(12) United States Patent
Theurer et al.

(10) Patent No.: US 6,668,728 B2
(45) Date of Patent: Dec. 30, 2003

(54) MACHINE FOR REHABILITATING A TRACK BED

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/214,815

(22) Filed: Aug. 8, 2002

(65) Prior Publication Data

US 2003/0037695 A1 Feb. 27, 2003

(30) Foreign Application Priority Data

Aug. 23, 2001 (AT) ..... 1342/2001

(51) Int. Cl.[7] ..... E01B 29/02
(52) U.S. Cl. ..... 104/2
(58) Field of Search ..... 104/2, 3, 4, 5, 104/7.1, 7.2, 7.3

(56) References Cited

U.S. PATENT DOCUMENTS 5,666,882 A * 9/1997 Theurer et al. ..... 104/3

FOREIGN PATENT DOCUMENTS

| | | |
|---|---|---|
| FR | 2 538 425 | 11/1983 |
| GB | 2 262 558 | 6/1993 |
| GB | 2 261 455 | 1/1995 |

* cited by examiner

*Primary Examiner*—S. Joseph Morano
*Assistant Examiner*—Robert J. McCarry, Jr.
(74) *Attorney, Agent, or Firm*—Collard & Roe, P.C.

(57) ABSTRACT

A track bed rehabilitating machine comprises a machine frame supported on a track by undercarriages for movement along the track in an operating direction. The machine frame comprises a first machine frame part, a second machine frame part and a third machine frame part. A first coupling links the second machine frame part to the first machine frame part, a second coupling links the third machine frame part to the second machine frame part, and one of the undercarriages is arranged adjacent the first coupling. Two crawler tractors are spaced from each other in a direction extending transversely to the machine frame and connected to the second machine frame part, and drives connect the crawler tractors to the second machine frame part for vertically adjusting the crawler tractors.

5 Claims, 2 Drawing Sheets

MACHINE FOR REHABILITATING A TRACK BED

BACKGROUND OF THE INVENTION

1. Field of the Invention

The present invention relates to machine for rehabilitating a track bed supporting a track comprising two rails, which comprises a machine frame supported on the track by undercarriages for movement along the track in an operating direction, the machine frame comprising machine frame parts being coupled together.

2. Description of the Prior Art

British patent No. 2,261,455 discloses a two-part machine for creating a protective layer on a subgrade. A coupling links a second machine frame part to a first machine frame part, and an undercarriage is arranged adjacent the coupling and is displaceable in a longitudinal direction of the machine frame to lengthen the track bed space from which the track has been lifted for performing the rehabilitation work. This space must be long enough to hold the bending curve of the lifted track rails within acceptable limits.

British patent No. 2,262,558 discloses another track bed rehabilitating machine comprising a machine frame whose ends are supported on the track by undercarriages. Two vertically adjustable crawler tractors are arranged at the front end of the machine frame to support the front end on the track bed while it is lifted with the track.

To lay a new track, French patent No. 2,538,525 proposes a machine having crawler tractors supporting a front end of the machine frame on the track bed while the rear machine frame end is supported by an undercarriage on the track.

SUMMARY OF THE INVENTION

It is a primary object of this invention to provide a machine for rehabilitating a track bed whose machine frame is supported on the track at its ends while providing an exceptionally long track bed space from which the track has been lifted for performing track bed rehabilitation work.

The above and other objects are accomplished according to the invention with a machine for rehabilitating a track bed supporting a track comprising two rails, which comprises a machine frame supported on the track by undercarriages for movement along the track in an operating direction, the machine frame comprising, in the operating direction, a first machine frame part, a second machine and a third machine frame part. A first coupling links the second machine frame part to the first machine frame part, a second coupling links the third machine frame part to the second machine frame part, and one of the undercarriages being arranged adjacent the first coupling. Two crawler tractors are spaced from each other in a direction extending transversely to the machine frame and connected to the second machine frame part, and drives connect the crawler tractors to the second machine frame part for vertically adjusting the crawler tractors.

Such a machine provides the possibility of substantially increasing the length of the track bed rehabilitation space at a minor increase in the construction costs. The two crawler tractors enable the second, central machine frame part to be supported on the subgrade subtending the track section limited by the two undercarriages supporting the machine frame ends on the track while this track section is lifted to a required height. Available machines with two-part machine frames may be readily retrofitted to insert a third machine frame part between the two machine frame parts.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF THE PREFERRED EMBODIMENT

Figure 1:
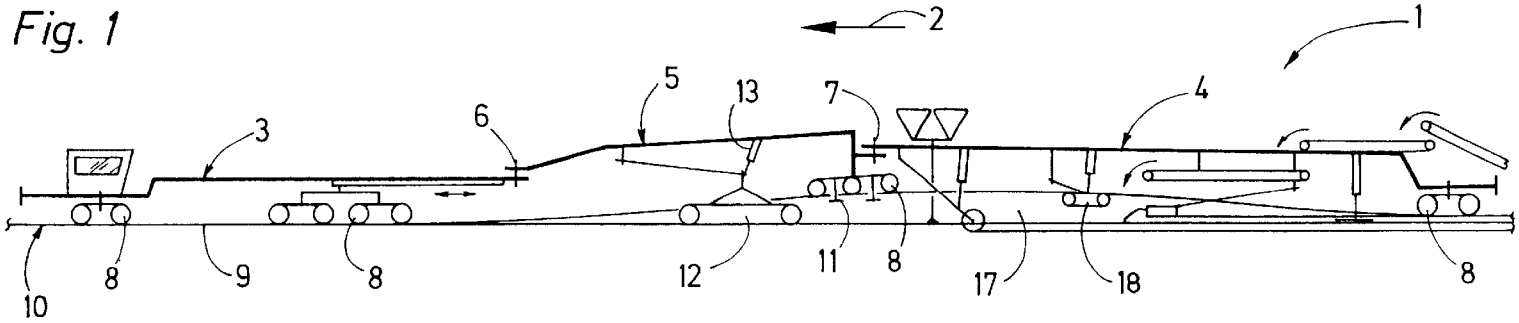
FIG. 1 shows a schematic side view of the machine.
Figure 2:
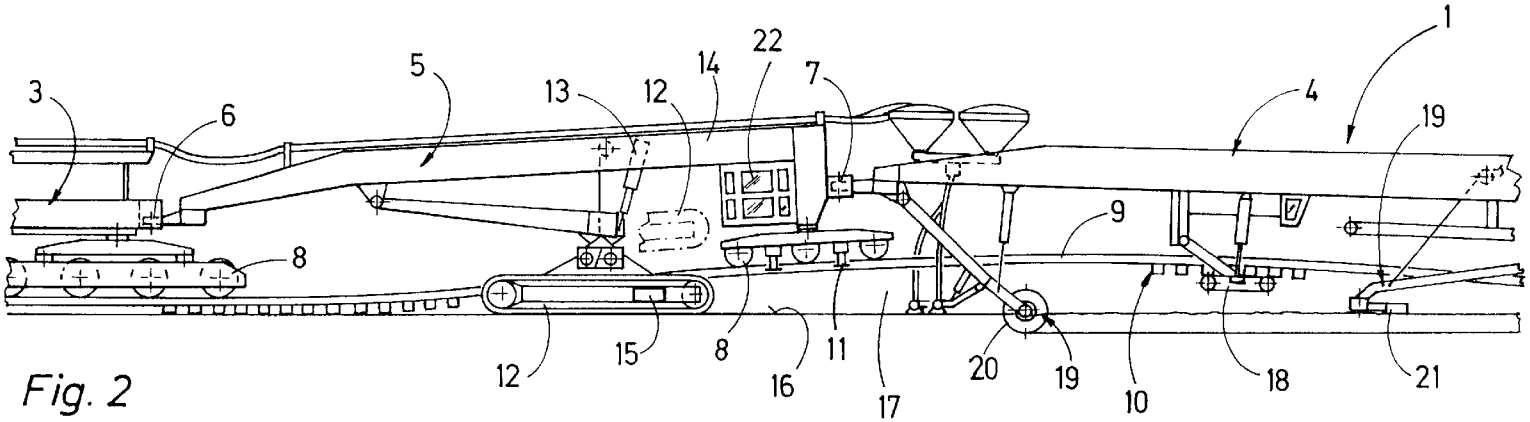
FIG. 2 is an enlarged partial side view, showing some details of the machine.

Referring now to the drawing and more particularly to FIGS. 1 and 2, there is shown machine 1 for rehabilitating a track bed supporting track 10 comprising two rails 9. The machine comprises a machine frame supported on track 10 by undercarriages 8 for movement along the track in an operating direction indicated by arrow 2. The machine frame comprises, in the operating direction, first machine frame part 3, second machine frame part 5 and third machine frame part 4. First coupling 6 links second machine frame part 5 to first machine frame part 3, and second coupling 7 links third machine frame part 4 to second machine frame part 5. One undercarriage 8 is arranged adjacent first coupling 6, and a second undercarriage 8 is arranged adjacent second coupling 7, the second undercarriage comprising track lifting device 11 having means for engaging the track rails (see FIG. 2).

Two crawler tractors 12 are spaced from each other in a direction extending transversely to the machine frame and are connected to second machine frame part 5, drives 13 connecting the crawler tractors to the second machine frame part for vertically adjusting the crawler tractors. The crawler tractors are driven by motor 15. As shown in FIGS. 1 and 2, crawler tractors 12 are positioned at a rear half 14 of second machine frame part 5, in the operating direction, preferably immediately in front of second undercarriage 8, in the operating direction.

Figure 3:
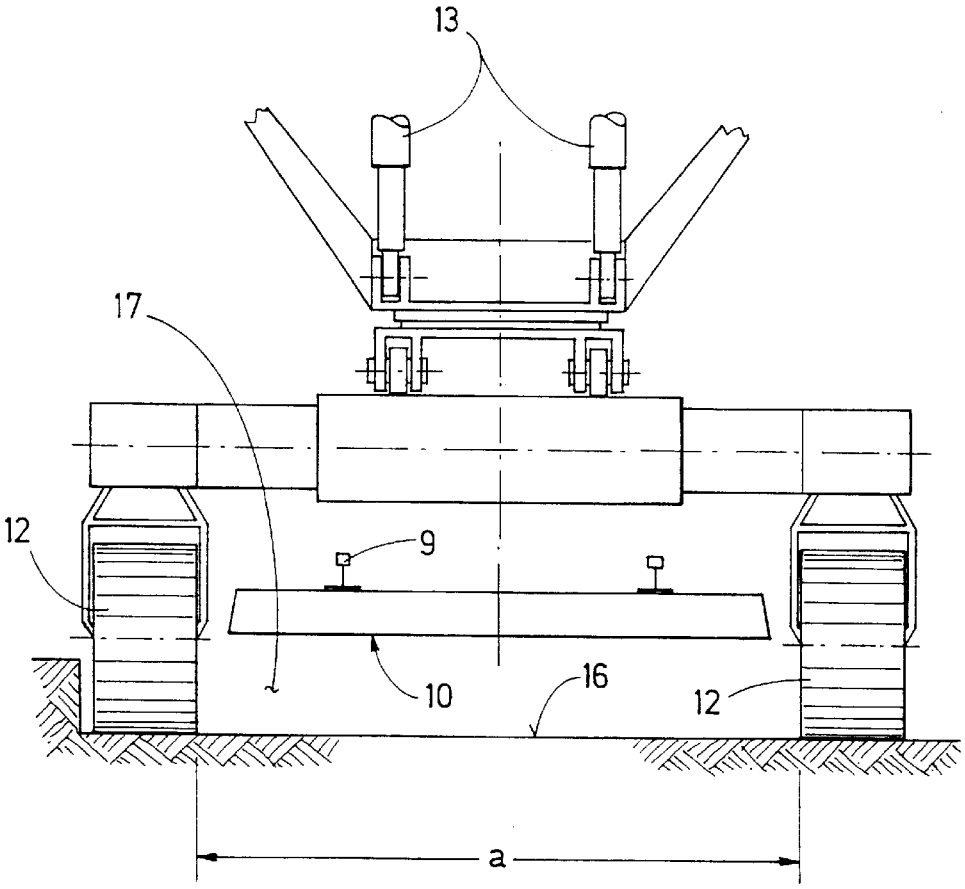
FIG. 3 is an enlarged end view showing the two crawler tractors.

As best shown in FIG. 3, the two crawler tractors 12 are mounted on a common frame and may be spaced from each other a distance of at least 2.5 m in a direction extending transversely to the machine frame so that they may be positioned on subgrade 16 of the track bed at each side of the track.

Machine 1 may be operated in the following manner:

Supported on track 10 on all undercarriages 8, the machine frame is driven to the operating site, with crawler tractors 12 lifted into the inoperative position by drives 13 (see phantom lines in FIG. 2). To provide a space 17 subtending track 10 for performing track bed rehabilition work, track rails 9 are clamped to track lifting device 11 and crawler tractors 12 are lowered onto subgrade 16, which causes second coupling 7, with undercarriage 8 adjacent thereto as well as the end portions of machine frame parts 5, 4, to be raised, as shown in FIG. 2. Track 10, being clamped to undercarriage 8 by track lifting device 11, is similarly raised to provide space 7 between subgrade 10 and raised track 10. A further track lifting device 18 is mounted on third machine frame part 4 to assist in raising track 10 and maintain it in the raised position. If desired, working space 17 may be further lengthened if undercarriage 8 adjacent first coupling 6 is longitudinally displaceable and is forwardly displaced in the operating direction.

As soon as track 10 is raised to provide work space 17, operating tools 19 may be introduced into the work space by lowering the operating tools onto subgrade 16. The illustrated operating tools comprise mixing device 20 for mixing soil with lime and a planing and consolidating device 21, following in the operating direction. However, any desired type of operating tools may be used, depending on the track bed rehabilitation work involved, such as an endless ballast excavating chain for removing ballast from the track bed.

An operator in operator's cab 22 mounted on second machine frame part 5 can operate crawler tractors 12, to lower and raise the same, as well as to steer it in track curves so that it remains properly centered relative to the track.

What is claimed is:

1. A machine for rehabilitating a track bed supporting a track comprising two rails, which comprises (a) a machine frame supported on the track by on-track undercarriages for movement along the track in an operating direction, the machine frame comprising, in the operating direction, (1) a first machine frame part having a free end supported on the track by one of the on-track undercarriages, (2) a second machine frame part and (3) a third machine frame part having a free end supported on the track by a second one of the on-track undercarriages, (b) a first coupling linking the second machine frame part to the first machine frame part at an end opposite the free end, (c) a second coupling linking the third machine frame part to the second machine frame part at an end opposite the free end, (d) a third one of the on-track undercarriages being arranged adjacent the first coupling, (e) two crawler tractors spaced from each ocher in a direction extending transversely to the machine frame and connected to the second machine frame part, and (f) drives connecting the crawler tractors to the second machine frame part for vertically adjusting the crawler tractors, (g) a track lifting device having means for engaging the track rails, and (h) operating tools for rehabilitating the track bed in a work space under a section of the track lifted by the track lifting device.

2. The track bed rehabilitating machine of claim 1, further comprising a fourth one of the undercarriages arranged adjacent the second coupling, the second fourth undercarriage comprising the track lifting device.

3. The track bed rehabilitating machine of claim 1, wherein the crawler tractors are positioned at a rear half of the second machine frame part, in the operating direction.

4. The track bed rehabilitating machine of claim 1, further comprising a fourth one of the undercarriages arranged adjacent the second coupling, the fourth undercarriage comprising the track lifting device, and the crawler tractors being positioned immediately in front of the fourth undercarriage, in the operating direction.

5. The track bed rehabilitating machine of claim 1, wherein the two crawler tractors are spaced from each other a distance of at least 2.5 m in a direction extending transversely to the machine frame.

* * * * *